US006120095A

United States Patent [19]

Rogers

[11] Patent Number: 6,120,095

[45] Date of Patent: Sep. 19, 2000

[54] GLIDING SEATING UNIT WITH HINGED GLIDING MEMBERS

[76] Inventor: W. Clark Rogers, P.O. Box 722, 172 Rogers La., Badin Lake, Denton, N.C. 27239-0722

[21] Appl. No.: 09/132,931

[22] Filed: Aug. 11, 1998

[51] Int. Cl.[7] ..... A47C 3/02

[52] U.S. Cl. ..... 297/273; 297/263.1; 297/271.3; 297/259.2; 248/370

[58] Field of Search ..... 297/259.1, 259.2, 297/259.3, 273, 271.1, 271.3, 271.4, 263.1; 248/370, 424

[56] References Cited

U.S. PATENT DOCUMENTS

| | | | |
|---|---|---|---|
| 144,603 | 11/1873 | Enger . | |
| 195,395 | 9/1877 | Pope . | |
| 2,142,714 | 1/1939 | Campbell . | |
| 2,869,619 | 1/1959 | Petersen et al. . | |
| 3,054,639 | 9/1962 | Schliephacke . | |
| 3,096,118 | 7/1963 | Dubeck . | |
| 3,243,225 | 3/1966 | Katz . | |
| 3,730,585 | 5/1973 | Rogers, Jr. et al. . | |
| 3,815,954 | 6/1974 | Rogers, Jr. et al. . | |
| 3,926,472 | 12/1975 | Evans | 297/259.2 |
| 4,291,913 | 9/1981 | Kowalski . | |
| 4,437,701 | 3/1984 | Mizelle . | |
| 4,519,647 | 5/1985 | Rogers, Jr. | 297/85 |
| 4,536,029 | 8/1985 | Rogers, Jr. . | |
| 4,544,201 | 10/1985 | Rogers, Jr. . | |
| 4,601,513 | 7/1986 | Pine . | |
| 4,700,920 | 10/1987 | Horn . | |
| 5,129,701 | 7/1992 | Pine . | |
| 5,344,214 | 9/1994 | Trent . | |
| 5,427,433 | 6/1995 | Holobaugh, Jr. . | |
| 5,704,686 | 1/1998 | May | 297/273 |
| 5,765,913 | 6/1998 | LaPointe et al. | 297/259.3 |

FOREIGN PATENT DOCUMENTS

| | | | |
|---|---|---|---|
| 818343 | 6/1937 | France . | |
| 818.343 | 9/1937 | France . | |
| 3524056 | 1/1987 | Germany . | |
| 91 15 439.1 | 5/1992 | Germany | A47C 7/14 |
| WO 97/14336 | 4/1997 | WIPO | A47C 3/02 |
| WO 97/39662 | 10/1997 | WIPO | A47C 13/10 |
| WO 98/16137 | 4/1998 | WIPO | A47C 1/02 |

*Primary Examiner*—Anthony D. Barfield
*Attorney, Agent, or Firm*—Myers, Bigel, Sibley & Sajovec

[57] ABSTRACT

The gliding seating unit of the present invention comprises: A base configured to reset upon an underlying surface; a seat overlying the base; a unitary front glide member, and unitary rear glide member. The front glide member is connected with the base and the seat and comprises an upper panel fixed to the base, a lower panel connected with the seat, and a gliding panel hingedly attached at an upper end to the upper panel and hingedly attached at a lower end to the lower panel. The rear glide member is connected with the base and the seat and comprises an upper panel fixed to the base, a lower panel connected with the seat, and a gliding panel hingedly attached at an upper end to the upper panel and hingedly attached at a lower end to the lower panel. The front and rear glide members are constructed and mounted such that the seat is suspended from the base and is free to glide along a longitudinal path responsive to a longitudinally-directed force, wherein the longitudinal path is defined by motion of the gliding panels of the front and rear glide members. Preferably, the front and rear glide members are formed of a polymeric material, such that the upper and lower panels of the front and rear glide members are connected to the glide panels via "living" hinges.

32 Claims, 7 Drawing Sheets

18
17a
17
18
66
69
68
20
18a
64
17
62
20a
17a
60
58
53
54
52
50
56
59
57
67
48
48
34
34
36
41
14
36
13

GLIDING SEATING UNIT WITH HINGED GLIDING MEMBERS

FIELD OF THE INVENTION

The present invention relates generally to seating units, and relates more particularly to gliding seating units.

BACKGROUND OF THE INVENTION

For many years, rocking chairs have been popular furniture pieces in the home. The repetitive rocking motion of the chair can be quite relaxing and comforting to a seated occupant. In addition, the appearance of the rocking chair is such that it can be used with a variety of furniture styles, particularly traditional styles with a heavy emphasis on visible wood.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Another type of seating unit that has become popular is the recliner chair. Recliners typically include some type of mechanism that, when actuated, causes the seat and backrest of the recliner to pivot relative to the base in order to place an occupant of the seating unit in a reclined position. Also, many recliners include an extendable footrest, or "ottoman," that extends forwardly of the seat and retracts beneath the seat as desired.

Reclining capability has been combined with gliding capability in a single unit to provide a chair that both reclines and glides. This chair includes a reclining mechanism that enables it to move between upright and one or more reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., the disclosures of which are hereby incorporated herein by reference in their entireties.

Despite their popularity, gliders, and in particular glider-recliners, have proven to have certain shortcomings. One concern with gliders is that the swing links can cause the chair to be somewhat noisy while gliding. Such noise is produced by the interaction between the swing links and the components to which they are mounted; as the swing links pivot, they rub against their respective mounting locations, which can produce squeaking. As a result, manufacturers of gliders typically lubricate these areas heavily. In addition, the rubbing interaction of the swing links against their mounting points can also cause the swing links to "catch" as the surfaces wear. As a result, the occupant of the chair may sense a less smooth gliding motion than would be preferred. The prior art is silent regarding solutions to these problems.

SUMMARY OF THE INVENTION

In view of the foregoing, it is an object of the present invention to provide a gliding seating unit that reduces or eliminates noise caused by the interaction of swing links with their mounting locations.

It is also an object of the present invention to provide a gliding seating unit that reduces the tendency of the occupant to sense that the unit is "catching" during gliding.

It is a further object of the present invention to provide such a gliding seating unit that also has reclining capability.

These and other objects are satisfied by the present invention, which is directed to a gliding seating unit that employs hinged front and rear glide links to impart gliding motion. More specifically, the gliding seating unit of the present invention comprises: a base configured to reset upon an underlying surface; a seat overlying the base; a unitary front glide member, and unitary rear glide member. The front glide member is connected with the base and the seat and comprises an upper panel fixed to the base, a lower panel connected with the seat, and a gliding panel hingedly attached at an upper end to the upper panel and hingedly attached at a lower end to the lower panel. The rear glide member is connected with the base and the seat and comprises an upper panel fixed to the base, a lower panel connected with the seat, and a gliding panel hingedly attached at an upper end to the upper panel and hingedly attached at a lower end to the lower panel. The front and rear glide members are constructed and mounted such that the seat is suspended from the base and is free to glide along a longitudinal path responsive to a longitudinally-directed force, wherein the longitudinal path is defined by motion of the gliding panels of the front and rear glide members. Preferably, the front and rear glide members are formed of a polymeric material, such that the upper and lower panels of the front and rear glide members are connected to the glide panels via "living" hinges.

In such a configuration, the glide panels of the front and rear glide members can pivot relative to their respective upper and lower panels without the rubbing action that accompanies the swing links of prior art gliders. As such, the glider can glide with less noise and without the "catching" action of prior art gliders.

In a preferred embodiment, the gliding seating unit of the present invention is a glider-recliner, and so includes a reclining mechanism attached to the seat. In this embodiment, the lower panels of the front and rear glide members are fixed to the reclining mechanism such that the seat and reclining mechanism are suspended above the base.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will finally convey the scope of the invention to those skilled in the art.

The present invention is directed to a gliding, reclining chair having a stationary base, a seat, and a backrest. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The forward and rearward directions together comprise the "longitudinal" directions relative to the chair. The term, "outward" and derivatives thereof refer to the direction defined by a vector originating in the center of the seat and extending in the plane of the underlying surface and perpendicular to the forward and rearward directions. The terms "inboard", "inward" and derivatives thereof refer to the direction directly opposite to the outward direction as defined hereinabove. The outward and inward directions together comprise the "lateral" directions relative to the chair.

In addition, mechanisms for moving portions of the seating unit illustrated herein between retracted and extended positions are illustrated as a series of pivotally interconnected links. Those skilled in this art will appreciate that the pivots between links illustrated herein can take a variety of configurations, such as pivot pins, rivets, bolt and nut combinations, and the like, any of which would be suitable for use with the present invention.

Figure 1:
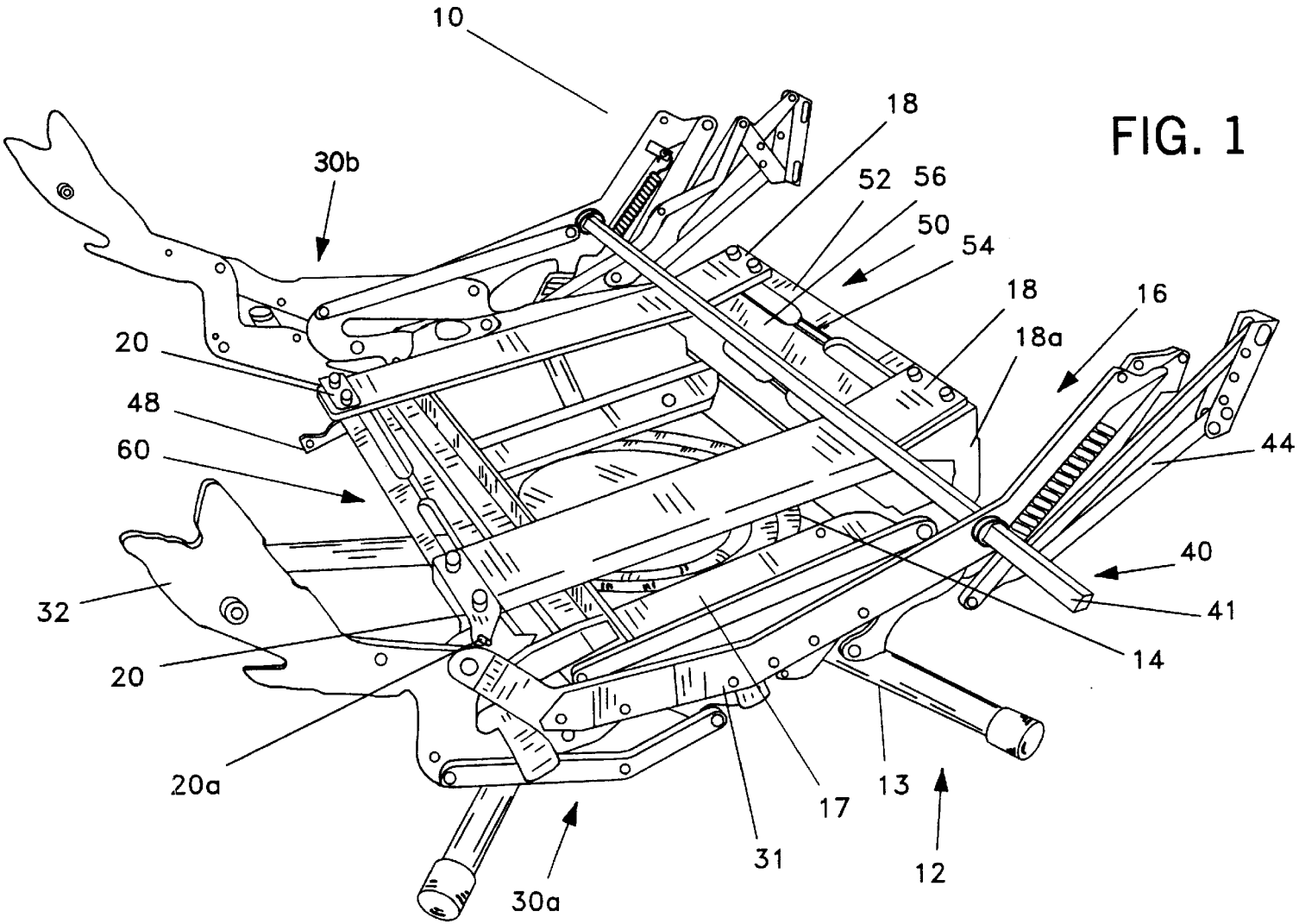
FIG. 1 is a partial perspective view of a frame and a pair of reclining mechanisms for a gliding, reclining chair of the present invention with the upholstery and chair frame removed for clarity.
Figure 2:
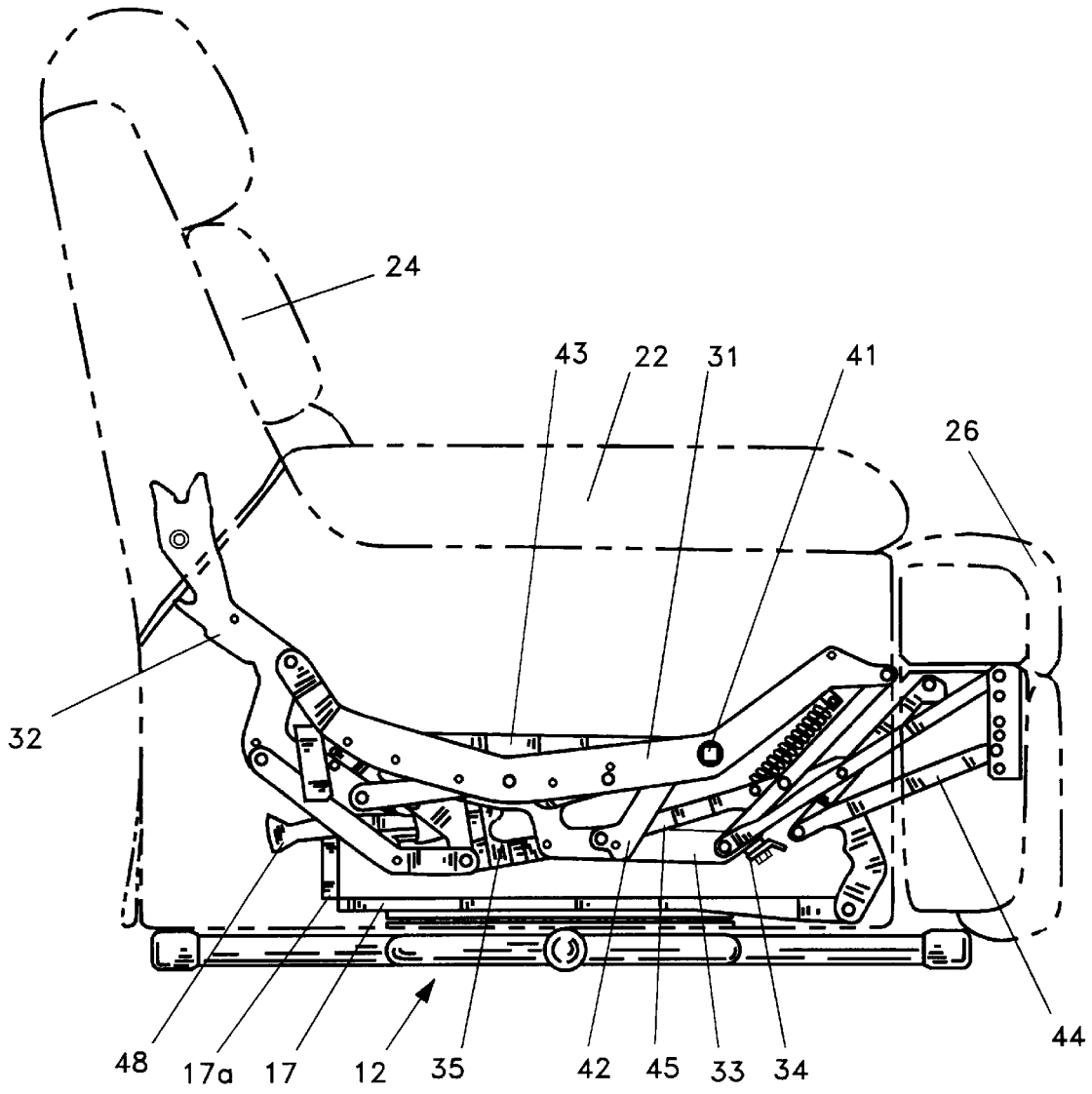
FIG. 2 is a cutaway side view of the chair of FIG. 1 in its upright position with upholstery indicated in phantom lines.
Figure 3A:
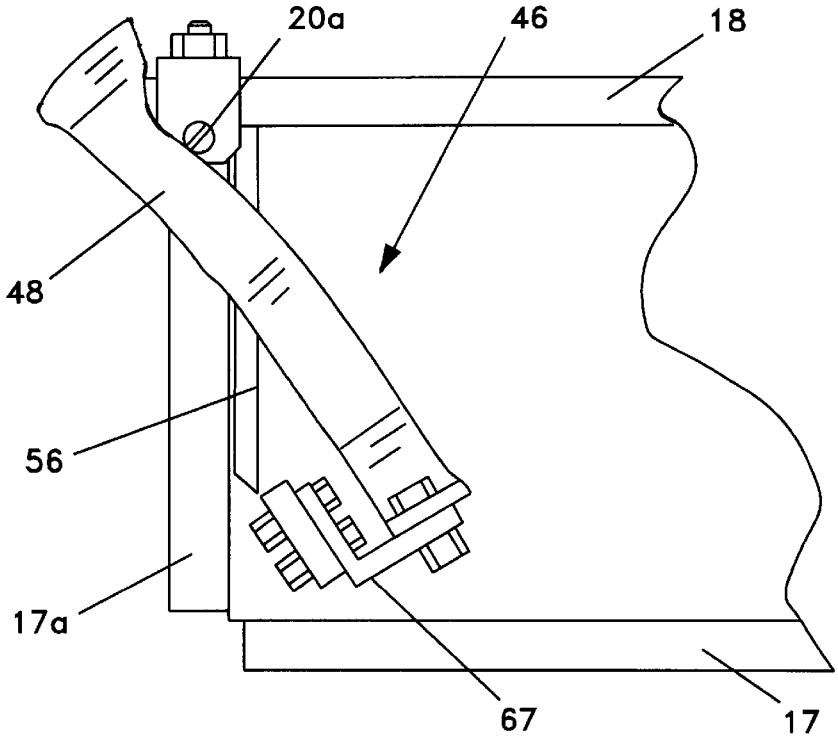
FIG. 3A is an enlarged partial side view of the stop linkage of the chair of FIG. 1 with the chair in the TV position.
Figure 3:
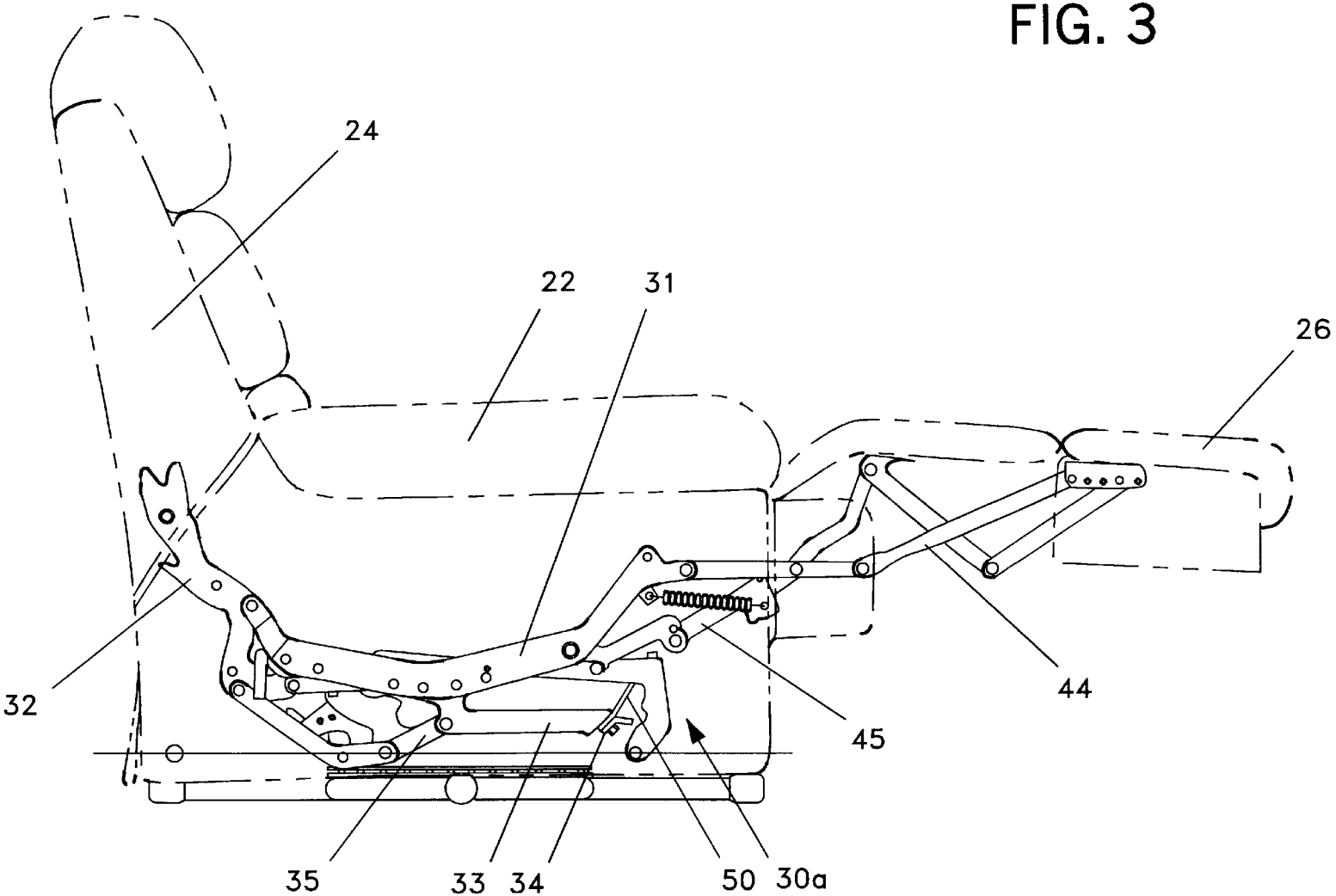
FIG. 3 is a cutaway side view of the chair of FIG. 1 in the TV position.
Figure 4:
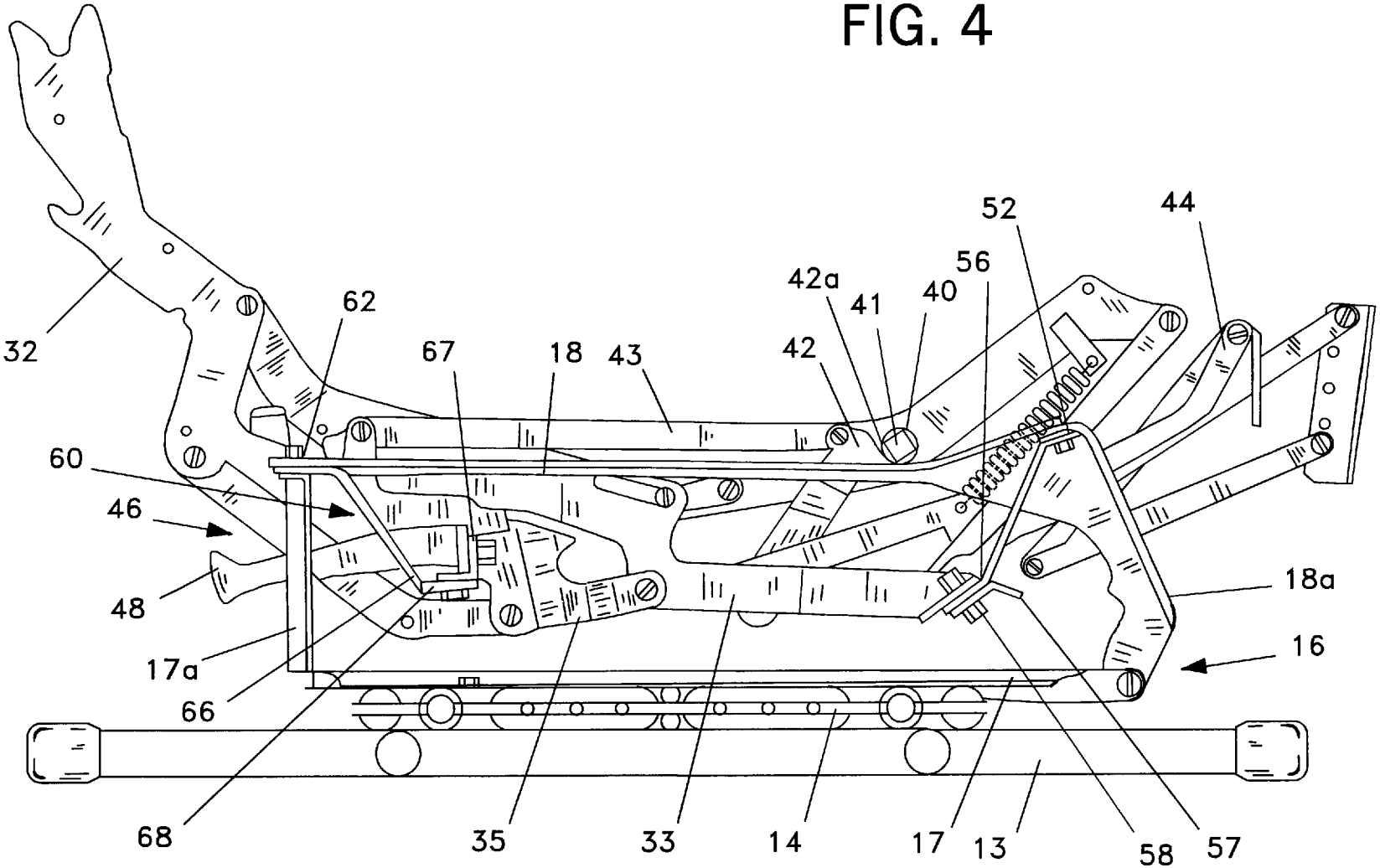
FIG. 4 is a section view taken along lines 4—4 of FIG. 1 showing the glide members of the chair.

Referring now to the drawings, a gliding, reclining chair, designated broadly at 10, is illustrated in FIGS. 1 through 6. As best seen in FIGS. 1, 2 and 4, the chair 10 includes a base 12 configured to rest on an underlying surface, a seat 22 positioned above the base 12, a backrest 24 positioned rearward of the seat 22, an extendable ottoman 26 that retracts to a position below the forward portion of the seat 22, a pair of three-way reclining mechanisms 30*a*, 30*b*, a front glide member 50 and a rear glide member 60. These components and their interrelationships are described in more detail below.

Figure 5:
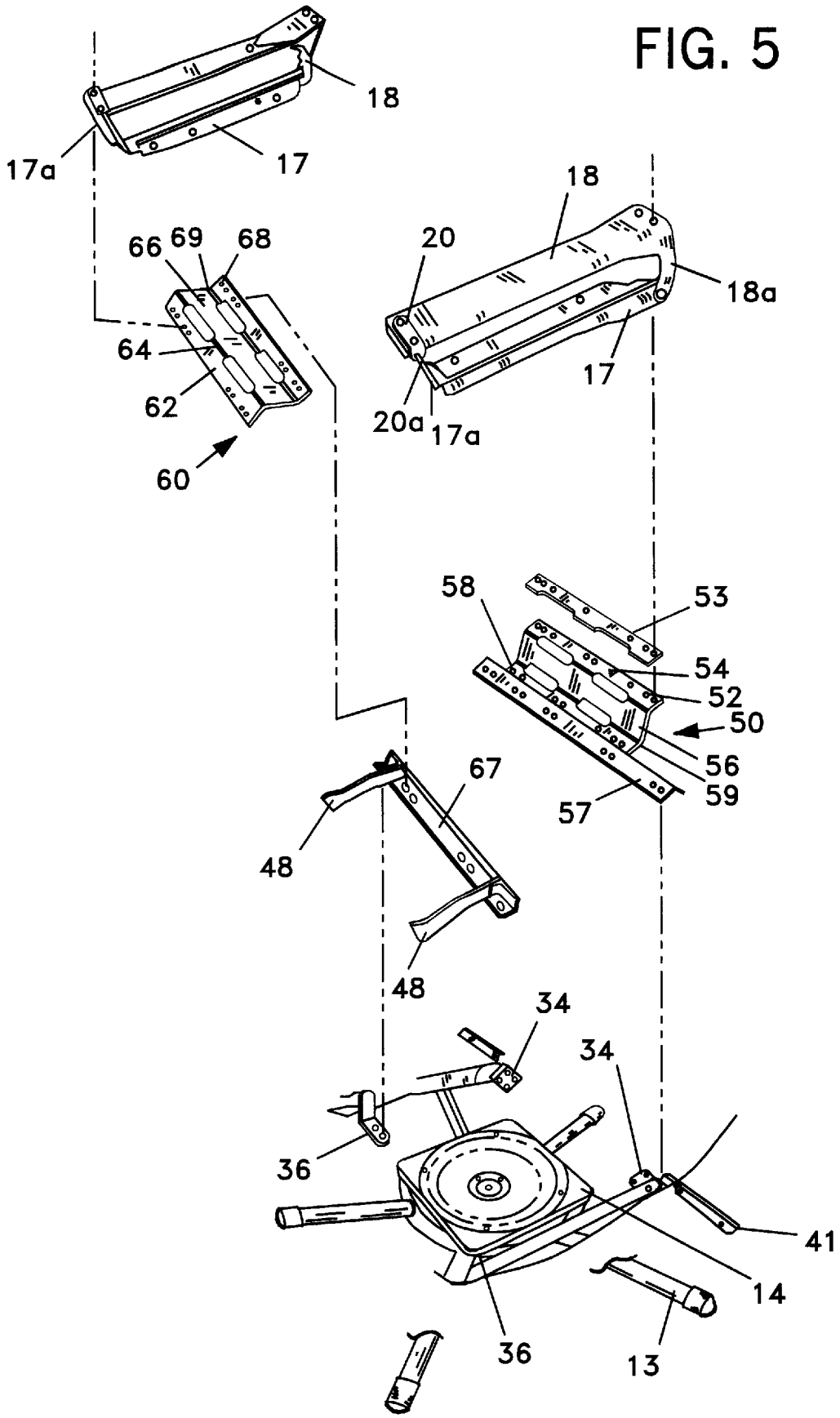
FIG. 5 is an exploded view of the base and glide members of the chair of FIG. 1.

Referring to FIG. 5, the base 12 includes a spider wheel 13 that rests on the underlying surface, a round swivel unit 14 attached to the top of the spider wheel 13, and a frame 16 fixed to the top of the swivel unit 14. As best seen in FIGS. 4 and 5, the frame 16 includes a pair of base members 17 fixed to the swivel unit 14 having upright portions 17*a* extending upwardly from the rear ends thereof. The frame 16 also includes a pair of top members 13 that extend forwardly from the upright portion 17*a* to a position beyond the front portion of the swivel unit 14, then extend downwardly therefrom with upright portions 18*a* that meet the front ends of the base members 17. A mounting bracket 20 is fixed to the top rear portion of each of the top members 18; a stop pin 20*a* extends outwardly from each mounting bracket 20.

Referring again to FIG. 1, the three-way reclining mechanisms 30*a*, 30*b* are positioned outwardly from the frame 16. As used herein, a "threeway" reclining mechanism indicates that the mechanism controls the movement of the seat 22 and backrest 24 between an upright position (see FIG. 2), an intermediate "TV" position (FIG. 3), in which the ottoman 26 is extended in front of the seat 22, and the backrest 24 and the seat 22 remain in the same positions relative to one another, and a fully reclined position (not shown), in which the backrest 44 reclines (is,, takes a shallower angle to the underlying surface) relative to the seat 22 and the ottoman 26 remains extended. The structure and operation of threeway mechanisms are well known in this art and need not be described in detail herein; those skilled in this art will recognize that other threeway reclining mechanisms can also be employed with chairs of the present invention. Exemplary reclining mechanisms include those illustrated in U.S. Pat. Nos. 4,319,780 and 4,519,647 to Rogers. Also, some two-way mechanisms (i.e., those that cause a backrest rigidly fixed to the seat to move between upright, TV, and fully reclined positions) and some one-way mechanisms (those that cause a backrest rigidly fixed to the seat to move between upright and reclined positions) can also be employed in chairs of the present invention.

The three-way reclining mechanisms 30*a* and 30*b* are mirror images of one another about a vertical, longitudinally-extending plane that bisects the chair 10 between the reclining mechanisms 30*a*, 30*b*. As such, only the reclining mechanism 30*a* will be described in detail herein. Those skilled in this art will recognize that this discussion is equally applicable to the reclining mechanism 30*b*.

Referring to FIGS. 2 and 3, the reclining mechanism 30*a* comprises a number of pivotally interconnected links that enable it to move the seat 22 and backrest 24 relative to the base 12 in the desired fashion. These include a seat link 31 to which the seat 22 is attached and a backrest post 32 to which the backrest 24 is attached. A carrier link 33 extends from a pivotal interconnection with the backrest post 32 downwardly and forwardly to terminate at a point below and rearwardly of the mounting flange 19 of the longitudinal member 17*b*. The carrier link 33 includes an inwardly-extending mounting tab 34 at its forward end. The reclining mechanism 30*a* also includes a connecting link 35 that is pivotally connected at its front portion to the carrier link 33 and extends upwardly and rearwardly therefrom. The connecting link 35 includes a mounting tab 36 that extends inwardly. The reclining mechanism 30*a* further includes a pantographic ottoman linkage 44 for extending the ottoman 26 forwardly of the seat 22 when the chair 10 is in its TV and fully reclined positions. The operation of the ottoman linkage 44 will be understood by those skilled in this art and need not be described in detail herein.

Best seen in FIG. 4, the reclining mechanism 30*a* also includes an actuation linkage 40 that controls the movement of the reclining mechanism 30*a* between its upright position and the TV position. The actuation linkage 40 includes a drive axle 41 of square cross section that extends through an aperture in the seat link 31, and further includes a bell crank 42 having an inwardly-extending flange 42*a* that rests against and is fixed to the lower rearward face of the drive axle 41. The bell crank 42 is pivotally interconnected at its upper end to the front end of a transition link 43, and is further pivotally interconnected at the lower end to an ottoman drive link 45 that is interconnected with the ottoman linkage 44. Rotation of a handle (not shown) attached at one end of the drive axle 41 causes the drive axle 41 to rotate (counterclockwise in the view shown in FIG. 4). Rotation of the drive axle 41 drives the bell crank 42 to rotate to the position illustrated in FIG. 3. Such rotation by the bell crank 42 forces the ottoman linkage 44 to extend the ottoman 26 and place the chair 10 in the TV position. From this position, the chair 10 can be moved to the fully reclined position by the occupant pushing rearwardly against the backrest.

Figure 6B:
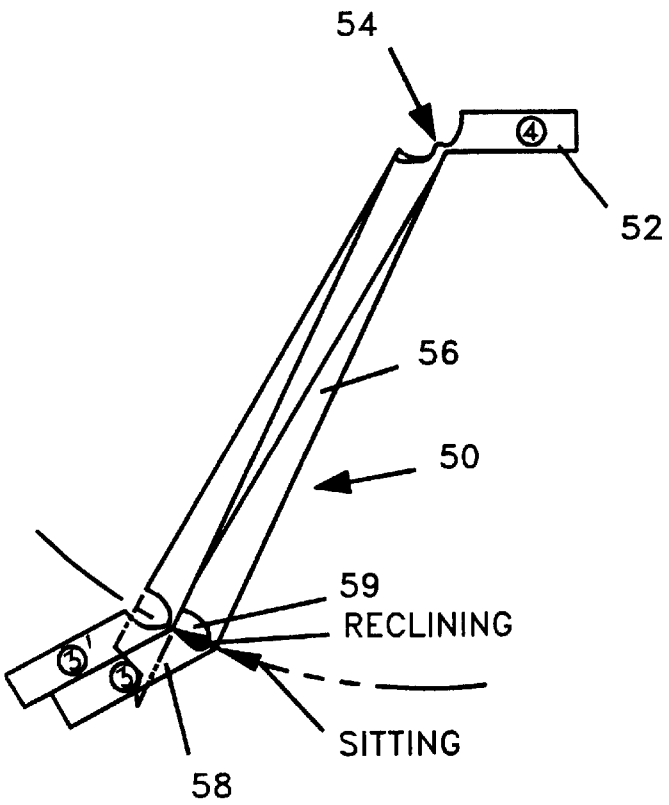
FIG. 6 is an enlarged schematic side view of the glide members of the chair of FIG. 1 illustrating the orientation of the glide members when the glide members are suspended from the frame (when the chair is in the upright position) and the orientations of the glide members when the chair is in the TV position.
Figure 6A:
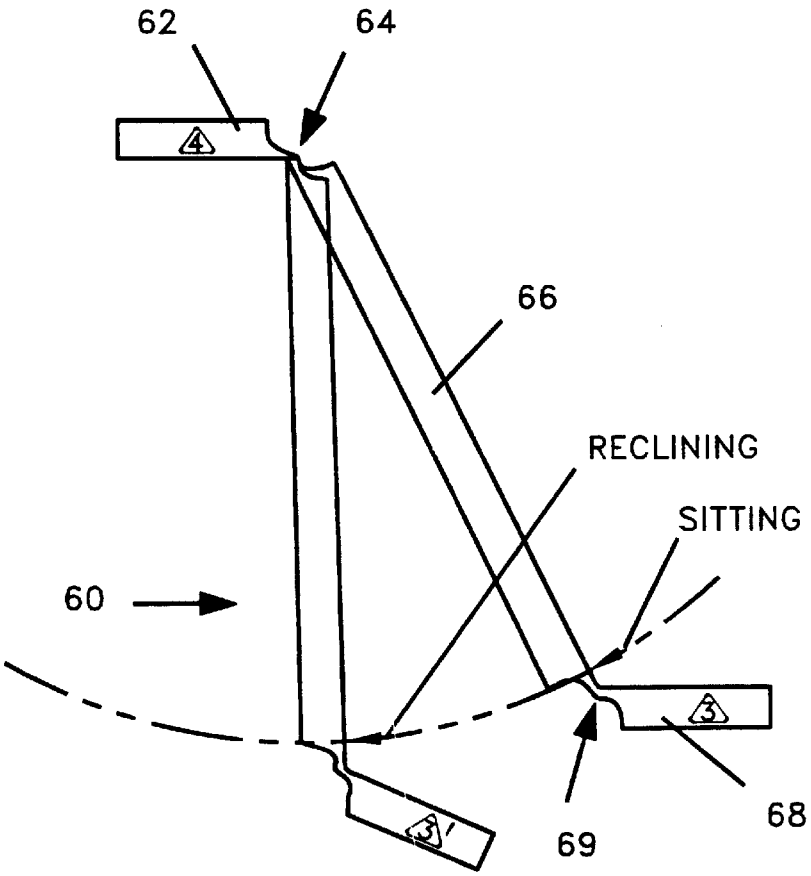

Referring now to FIGS. 4, 5 and 6, the reclining mechanism 30*a*, and in turn the seat 22 and backrest 24, are interconnected with the base 12 via the front and rear glide members 50, 60. The front glide member 50 is a unitary component formed of a polymeric material such as polypropylene or nylon, and includes an upper panel 52, a gliding panel 56, and a lower panel 58, each of which is between about 0.15 and 0.25 inches in thickness, with a thickness of about 0.1875 inches being preferred. As shown in FIG. 6, the upper panel 52 is separated from the gliding panel 56 by an upper recess 54, and the gliding panel 56 is separated from the lower panel 58 by a lower recess 59. The upper and lower recesses 54, 59, each of which has a depth of between about 0.09 and 0.12 inches, define the pivot axes of so-called "living hinges" that enable the gliding panel 56 to be pivoted repeatedly relative to the upper panel 52 and the lower panel 58. Notably, the upper and lower recesses 54, 59 face in generally the same direction, i.e., the upper access 54 is formed into one surface of the gliding panel 56, and the lower recess is formed in the same surface of the gliding panel 56. Those skilled in the design of living hinges will appreciate that virtually any design which a material appropriate/or living hinges is formed with a thinner "hinge" section between two thicker "non-hinge" section may be suitable for use with the present invention. Also, other polymeric materials, including those reinforced with an organic or inorganic filler or reinforcing material, can be used with the prevent invention.

As can be seen in FIGS. 4 and 5, the upper panel 52 is fixed to the underside of the top members 18 with a spacer bar 53 that extends transversely between the top members 18 positioned between the upper panel 52 and the top members 18. The upper recess 54 faces generally rearwardly and slightly upwardly. The lower panel 58 is fixed to a front cross member 57 that extends transversely between the mounting tabs 34 of the carrier links 33 of the reclining mechanisms 30*a*, 30*b* such that the lower recess 59 faces generally forwardly and downwardly. At rest, the gliding panel 56 slopes downwardly and slightly rearwardly from the upper panel 52 (FIGS. 4 and 6).

Referring to FIGS. 4 through 6, the unitary, polymeric rear glide member 60 includes an upper panel 62, a gliding panel 66 and a lower panel 68, with the upper and gliding panels 62, 66 being separated by an upper recess 64, and the gliding and lower panels 66, 68 being separated by a lower recess 69. The rear glide member 60 is also formed of a polymeric material. As with the front glide member 50, the presence of the upper and lower recesses 64, 69 in the rear glide member 60 forms living hinges that enable the gliding panel 66 to pivot repeated relative to the upper and lower panels 62, 68. The upper panel 62 is fixed to the underside of the rear portion of the top members 18 mounting flange 20 of the base 12, such that the upper recess 64 faces generally upwardly and forwardly. The lower panel 68 is fixed to a rear cross member 67 that extends transversely between the mounting tabs 36 of the connecting links 35 of the reclining mechanisms 30*a*, 30*b* In this configuration, the gliding panel 66 slopes downwardly and slightly forwardly in extending from the upper panel 62.

In the illustrated configuration, the seat 22, backrest 24, ottoman 26 and reclining mechanisms 30*a*, 30*b* are suspended from the frame 16 by the front and rear glide members 50, 60. As such, these components are free to glide along a longitudinal path defined by the gliding panels 56, 66 of the front and rear glide members 50, 60 as they pivot relative to their respective upper and lower panels (see FIG. 6).

Figure 2A:
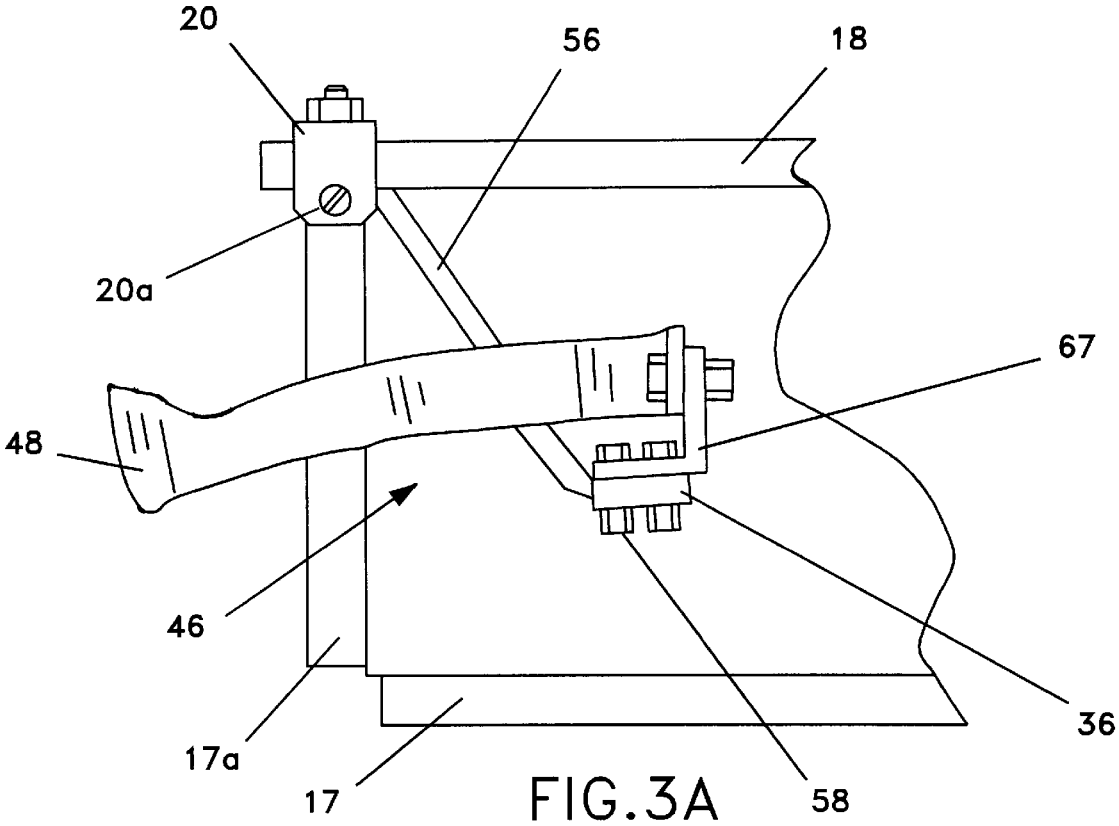
FIG. 2A is an enlarged partial side view of the stop linkage of the chair of FIG. 1 with the chair in the upright position.

In addition, the reclining mechanism 30*a* includes a stop linkage 46 coupled thereto. The stop linkage 46 (FIGS. 2A and 5) includes an extender bar 48 that is fixed to and extends rearwardly from the rear cross member 67 that is attached between the mounting tabs 36 of the connecting link 35. When the reclining mechanisms 30*a*, 30*b* move the chair 10 from the upright position of FIG. 2 to the TV position of FIG. 3, the connecting link 35 rotates (clockwise in the view in FIGS. 2 and 3), such that the extender bar 48 also rotates clockwise. The rotation of the extender bar 48 ceases when it strikes a stop pin 49 that extends outwardly from the longitudinal member 17*b*. Once in this position, the extender bar 48 prevents the seat 22 and backrest 24 from gliding relative to the base 12 and frame 16, thereby stabilizing the chair 10 when it is in either the TV or fully reclined positions.

The advantages provided by the front and rear gliding members 50, 60 are many. First, because of the nature of the living hinge configuration of the gliding members 50, 60, the noise and "catching" problems sometimes associated with prior gliders can be eliminated, as there are no components that have rubbing surfaces in the front and rear gliding members 50, 60. Second, the gliding members 50, 60 can be manufactured easily by extrusion or injection molding, each of which can provide consistent, inexpensive components. Third, because as illustrated the gliding members span the distance between the reclining mechanisms 30*a*, 30*b* on either side of the chair 10, there is no need for additional cross members that interconnect separate glide links in order synchronize and stabilize their motion. Fourth, the resistance to the gliding motion provided by the living hinges can be adjusted by simply adjusting the depth of the recess in the glide members, changing materials, or including (as illustrated) apertures in the glide members 50, 60 along the pivot axes. Fifth, these performance advantages can be achieved in almost any gliding seating unit currently being manufactured that employs swing links as the gliding mechanism, as the gliding members can simply be mounted to replace the swing links and provide the same motion to the chair.

It should also be appreciated by those skilled in this art that, although a glider-recliner chair is illustrated and described herein, other seating units, including those that lack reclining capability and those that serve multiple occupants, can also benefit from the use of the concepts of the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A gliding seating unit, comprising:

a base configured to rest upon an underlying surface;

a seat overlying said base;

a unitary front glide member connected with said base and said seat, said front glide member comprising an upper panel fixed to said base, a lower panel connected with said seat, and a gliding panel hingedly attached at an upper end to said upper panel and hingedly attached at a lower end to said lower panel;

a unitary rear glide member connected with said base and said seat, said rear glide member comprising an upper panel fixed to said base, a lower panel connected with said seat, and a gliding panel hingedly attached at an upper end to said upper panel and hingedly attached at a lower end to said lower panel;

said front and rear glide members being constructed and mounted such that said seat is suspended from said base and is free to glide along a longitudinal path responsive to a longitudinally-directed force, the longitudinal path being defined by motion of said gliding panels of said front and rear glide members.

2. The gliding unit defined in claim 1, wherein said front and rear glide members are each formed from a polymeric material.

3. The gliding unit defined in claim 2, wherein said polymeric material is propylene.

4. The gliding unit defined in claim 1, wherein each of said front and rear glide members includes a first recess between respective upper and gliding panels and a second recess between respective gliding and lower panels, said first and second recesses of said front and rear gliding members defining pivot axes about which said gliding panels pivot relative to said base and said seat.

5. The gliding unit defined in claim 4, wherein said first and second recesses of said rear gliding member face in generally opposite directions.

6. The gliding unit defined in claim 1, further comprising a reclining mechanism attached to said seat and to said lower panels of said front and rear gliding members, said reclining mechanism configured to move said seat relative to said base between upright and reclined positions.

7. The gliding unit defined in claim 6, further comprising a backrest positioned rearwardly of said seat, and wherein said reclining mechanism is a three-way reclining mechanism attached to said seat and said backrest.

8. The gliding unit defined in claim 7, wherein said lower panel of said front glide member is fixed to a carrier link of said reclining mechanism.

9. The gliding unit defined in claim 7, wherein said lower panel of said rear glide member is fixed to a connecting link of said reclining mechanism.

10. The gliding unit defined in claim 6, further including a retractable stop linkage that is moveable between a retracted position that allows said seat to glide relative to said base and an extended position that prevents said seat from gliding relative to said base, said stop linkage being coupled to said reclining mechanism such that said stop linkage takes its retracted position when said reclining mechanism is in the upright position and said stop linkage takes its extended position when said reclining mechanism is in the reclined position.

11. A gliding seating unit, comprising:

a base configured to rest upon an underlying surface;

a seat overlying said base;

a unitary front glide member formed of a polymeric material and connected with said base and said seat, said front glide member comprising an upper panel fixed to said base, a lower panel connected with said seat, and a gliding panel positioned between said upper and lower panels and hingedly attached thereto with respective upper and lower living hinges;

a unitary rear glide member formed of a polymeric material and connected with said base and said seat, said front glide member comprising an upper panel fixed to said base, a lower panel connected with said seat, and a gliding panel positioned between said upper and lower panels and hingedly attached thereto with respective upper and lower living hinges;

said front and rear glide members being constructed and arranged such that said seat is suspended from said base and is free to glide along a longitudinal path responsive to a longitudinally-directed force, the longitudinal path being defined by motion of said gliding panels of said front and rear glide members.

12. The gliding unit defined in claim 11, wherein said polymeric material is polypropylene.

13. The gliding unit defined in claim 11, further comprising a reclining mechanism attached to said seat and to said lower panels of said front and rear gliding members, said reclining mechanism configured to move said seat relative to said base between upright and reclined positions.

14. The gliding unit defined in claim 13, further comprising a backrest positioned rearwardly of said seat, and wherein said reclining mechanism is a three-way reclining mechanism attached to said seat and said backrest.

15. The gliding unit defined in claim 14, wherein said lower panel of said front glide member is fixed to a carrier link of said reclining mechanism.

16. The gliding unit defined in claim 14, wherein said lower panel of said rear glide member is fixed to a connecting link of said reclining mechanism.

17. The gliding unit defined in claim 13, further including a retractable stop linkage that is moveable between a retracted position that allows said seat to glide relative to said base and an extended position that prevents said seat from gliding relative to said base, said stop linkage being coupled to said reclining mechanism such that said stop linkage takes its retracted position when said reclining mechanism is in the upright position and said stop linkage takes its extended position when said reclining mechanism is in the reclined position.

18. A gliding reclining seating unit, comprising:

a base configured to rest upon an underlying surface;

a seat overlying said base;

a backrest positioned rearwardly of said seat;

a reclining mechanism attached to said seat, said reclining mechanism configured to move said seat relative to said base between upright and reclined positions;

a unitary front glide member attached to said base and said reclining mechanism, said front glide member comprising an upper panel fixed to said base, a lower panel fixed to said reclining mechanism, and a gliding panel hingedly attached at an upper end to said upper panel and hingedly attached at a lower end to said lower panel;

a unitary rear glide member attached to said base and said reclining mechanism, said rear glide member comprising an upper panel fixed to said base, a lower panel fixed to said reclining mechanism, and a gliding panel hingedly attached at an upper end to said upper panel and hingedly attached at a lower end to said lower panel;

said front and rear glide members being constructed and arranged such that said seat and said reclining mechanism are suspended from said base and is free to glide along a longitudinal path responsive to a longitudinally-directed force, the longitudinal path being defined by motion of said gliding panels of said front and rear glide members.

19. The gliding unit defined in claim 18, wherein said front and rear glide members are each formed from a polymeric material.

20. The gliding unit defined in claim 19, wherein said polymeric material is polypropylene.

21. The gliding unit defined in claim 18, wherein each of said front and rear glide members includes a first recess between respective upper and gliding panels and a second recess between respective gliding and lower panels, said first and second recesses of said front and rear gliding members defining pivot axes about which said gliding panels pivot relative to said base and said seat.

22. The gliding unit defined in claim 21, wherein said first and second recesses of said rear gliding member face in generally opposite directions.

23. The gliding unit defined in claim 18, wherein said reclining mechanism is a three-way reclining mechanism attached to said seat and said backrest.

24. The gliding unit defined in claim 18, further including a retractable stop linkage that is moveable between a retracted position that allows said seat to glide relative to said base and an extended position that prevents said seat from gliding relative to said base, said stop linkage being coupled to said reclining mechanism such that said stop linkage takes its retracted position when said reclining mechanism is in the upright position and said stop linkage takes its extended position when said reclining mechanism is in the reclined position.

25. The gliding unit defined in claim 18, wherein said lower panel of said front glide member is fixed to a carrier link of said reclining mechanism.

26. The gliding unit defined in claim 18, wherein said lower panel of said rear glide member is fixed to a connecting link of said reclining mechanism.

27. A gliding reclining seating unit, comprising:

a base configured to rest upon an underlying surface;

a seat overlying said base;

a backrest positioned rearwardly of said seat;

a reclining mechanism attached to said seat, said reclining mechanism configured to move said seat and said backrest relative to said base between upright and reclined positions;

a unitary front glide member formed of a polymeric material and connected with said base and said reclining mechanism, said front glide member comprising an upper panel fixed to said base, a lower panel fixed to said reclining mechanism, and a gliding panel positioned between said upper and lower panels and hingedly attached thereto with respective upper and lower living hinges;

a unitary rear glide member formed of a polymeric material and connected with said base and said reclining mechanism, said rear glide member comprising an upper panel fixed to said base, a lower panel fixed to said reclining mechanism, and a gliding panel positioned between said upper and lower panels and hingedly attached thereto with respective upper and lower living hinges;

said front and rear glide members being constructed and arranged such that said seat is suspended from said base and is free to glide along a longitudinal path responsive to a longitudinally-directed force, the longitudinal path being defined by motion of said gliding panels of said front and rear glide members.

28. The gliding unit defined in claim 27, wherein said polymeric material is polypropylene.

29. The gliding unit defined in claim 27, wherein said reclining mechanism is a three-way reclining mechanism attached to said seat and said backrest.

30. The gliding unit defined in claim 29, wherein said lower panel of said front glide member is fixed to a carrier link of said reclining mechanism.

31. The gliding unit defined in claim 29, wherein said lower panel of said rear glide member is fixed to a connecting link of said reclining mechanism.

32. The gliding unit defined in claim 27, further including a retractable stop linkage that is moveable between a retracted position that allows said seat to glide relative to said base and an extended position that prevents said seat from gliding relative to said base, said stop linkage being coupled to said reclining mechanism such that said stop linkage takes its retracted position when said reclining mechanism is in the upright position and said stop linkage takes its extended position when said reclining mechanism is in the reclined position.

* * * * *

UNITED STATES PATENT AND TRADEMARK OFFICE

CERTIFICATE OF CORRECTION

PATENT NO. : 6,120,095

DATED : September 19, 2000

INVENTOR(S) : W. Clark Rogers

It is certified that error appears in the above-identified patent and that said Letters Patent is hereby corrected as shown below:

Column 4, line 1 correct "13" to read -- 18 --.

Column 4, line 18 correct "(is,," to read -- (i.e.,--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*